US005562342A

United States Patent [19]

Nino

[11] Patent Number: 5,562,342

[45] Date of Patent: Oct. 8, 1996

[54] REFLECTOR FOR VEHICULAR HEADLIGHT

[75] Inventor: Naohi Nino, Shizuoka, Japan

[73] Assignee: Koito Manufacturing Co., Ltd., Tokyo, Japan

[21] Appl. No.: 280,613

[22] Filed: Jul. 26, 1994

[30] Foreign Application Priority Data

Jul. 26, 1993 [JP] Japan ..... 5-202470

[51] Int. Cl.[6] ..... F21V 7/06

[52] U.S. Cl. ..... 362/346; 362/61; 362/297; 362/347

[58] Field of Search ..... 362/346, 347, 362/61, 80

[56] References Cited

U.S. PATENT DOCUMENTS

| | | | |
|---|---|---|---|
| 3,492,474 | 1/1970 | Yamaguchi et al. | 362/350 |
| 4,481,563 | 11/1984 | Snyder et al. | 362/296 |
| 4,530,042 | 7/1985 | Cibie et al. | 362/309 |
| 4,566,056 | 1/1986 | Kouchi et al. | 362/346 |
| 4,612,608 | 9/1986 | Peitz | 362/297 |
| 4,754,374 | 6/1988 | Collot | 362/346 |
| 4,755,919 | 7/1988 | Lindae et al. | 362/346 |
| 4,772,988 | 9/1988 | Brun | 362/61 |
| 4,803,601 | 2/1989 | Collot et al. | 362/80 |
| 4,924,359 | 5/1990 | Lindae et al. | 362/61 |
| 5,003,435 | 3/1991 | Nakata | 362/346 |
| 5,003,447 | 3/1991 | James et al. | 362/346 |
| 5,215,368 | 6/1993 | Neumann | 362/346 |
| 5,258,897 | 11/1993 | Nino | 362/346 |
| 5,390,097 | 2/1995 | Nino | 362/346 |
| 5,450,295 | 9/1995 | Nino | 362/346 |

FOREIGN PATENT DOCUMENTS

| | | | |
|---|---|---|---|
| 2252151 | 7/1992 | United Kingdom | F21M 3/08 |

OTHER PUBLICATIONS

U.S. Patent Application 8/126,308 filed Sep. 24, 1993 by Nino.

*Primary Examiner*—Leonard E. Heyman
*Attorney, Agent, or Firm*—Sughrue, Mion, Zinn, Macpeak & Seas

[57] ABSTRACT

A reflection surface is divided into four reflection areas by means of a horizontal surface, a vertical surface and a surface inclined with respect to the horizontal surface, the three surfaces respectively including the optical axis of the reflector. The four reflection areas include a basic surface. The basic surface is an aggregate (envelope surface) of intersection lines obtained when a virtual paraboloid of revolution, which includes a reference parabola in the horizontal surface or inclined surface and has as a focus (second focus) a point on an optical axis passing through the vertex and focus of the reference parabola and situated in front of or to the rear of a focus (first focus) with respect to the vertex, is cut by vertical surfaces respectively including the optical axis. The focal positions of the sections (parabolas) in the adjoining reflection areas are made to coincide with one another to make the boundaries of the reflected areas continuous with one another, and also the positional relation between a filament and the first and second focuses of each of the reflection areas is controlled.

12 Claims, 10 Drawing Sheets

REFLECTOR FOR VEHICULAR HEADLIGHT

BACKGROUND OF THE INVENTION

The present invention relates to a reflector for a vehicular headlight and, in particular, to a reflector for a vehicular headlight which uses a light distribution control operation provided by four reflection areas divided about the optical axis of the reflector to obtain a desired light distribution pattern suitable for a low (passing) beam, or a beam substantially similar to a low beam.

Recent trends in car design require the development of new types of headlights. Particularly, to obtain desired aerodynamic characteristics and to provide a streamlined appearance, the front portion of the car is narrowed to provide a so-called slant nose appearance, and therefore the headlight must be designed so as to conform to the slant nose shape.

However, in a conventional headlight, lens steps in an outer lens play an important role in light distribution control so as to form a light distribution pattern having a specific cut line in the low beam. There is a limit though to the angle of inclination of the outer lens with respect to its vertical axis, which makes it difficult for the conventional headlight to serve as a slant-nose type headlight.

In view of the above, there have been proposed various headlights in which, in order to shift the light distribution control function originally performed by the lens steps in the outer lens to the reflector, the reflecting surface of the reflector is divided into a large number of light distribution control areas such that the composite pattern of the reflection patterns provided by the respective control areas approximates a desired light distribution pattern, thereby reducing the burden on the outer lens in light distribution control.

However, in trying to obtain a light distribution pattern having a specific cut line with a conventional reflection surface, when the reflection surface is composed of a plurality of reflection areas having different light distribution control characteristics, it is difficult to smoothly connect the mutually adjoining reflection areas to each other at their boundaries, and therefore a portion of the reflected light is unavoidably converted into upwardly facing light due to the presence of stepped portions formed at the boundaries of the reflection areas, which may result in glare.

SUMMARY OF THE INVENTION

The present invention was made in order to solve the above problems. In a reflector for use in a vehicular headlight according to the invention, a reflection surface is divided into four reflection areas disposed around the optical axis of the reflector by a horizontal surface including the optical axis of the reflector, a vertical surface including the optical axis of the reflector, and an inclined surface inclined at a given angle with respect to the horizontal surface including the optical axis of the reflector, and a basic surface for the respective reflection areas is formed so as to have a shape defined as follows.

The basic surface includes a reference parabola in a surface inclined at a given angle with respect to a horizontal surface including the optical axis of the reflector, and includes a reference point on an optical axis passing through the vertex and focus of the reference parabola and which is also disposed in front of or to the rear of the focus. Also, the basic surface is formed as an aggregate of intersection lines obtained when a virtual paraboloid of revolution, which includes an optical axis parallel to the ray vector of a reflected ray obtained when a ray assumed to have been emitted from the reference point is reflected at an arbitrary point on a parabola obtained by projecting the reference parabola in the horizontal surface and has as its focus a reference point passing through a reflection point, is cut by virtual planes respectively including the above-mentioned ray vector and parallel to a vertical axis.

In other words, the virtual paraboloid of revolution has as its focus a reference point shifted a certain distance from the focus of the reference parabola, and, when a ray is assumed to have been emitted from the focus, includes an optical axis parallel to the ray vector of the ray reflected at a reflection point on an orthogonal projection of the reference parabola on the horizontal surface (when the reference parabola lies in the horizontal surface, a reflection point on the reference parabola), and also includes a reflection point.

Also, the virtual plane is a plane which passes through the above-mentioned reflection point, includes the ray vector of the reflected light, and is parallel to a vertical line.

The intersection lines between the virtual paraboloid of revolution and planes form the basic surface when they are aggregated.

In a state in which the central shaft of a light source is positioned along the optical axis of a reflector, a first reflection area is located on top of a horizontal surface including the optical axis of the reflector, the focus of a first parabola consisting of a section of the first reflection area in the vertical surface including the optical axis of the reflector is located in the vicinity of or to the rear of the rear end of the light source, and the focus of a parabola consisting of a section of the first reflection area in a horizontal surface including the optical axis of the reflector is located between a position shifted rearwardly a distance corresponding to the length of the light source in the optical axis direction from the focus of the first parabola and a position shifted forwardly a distance corresponding to the length of the light source in the optical axis direction thereof from a parabola consisting of a section of a fourth reflection area in the vertical surface.

A second reflection area is located on top of the inclined surface, the focus of a parabola consisting of a section of the second reflection area obtained when the second reflection area is cut in the vertical surface including the optical axis of the reflector is identical with the focus of a parabola consisting of the section of the first reflection area in the vertical surface, and the focus of a parabola consisting of a section of the second reflection area in the inclined surface is located between a position shifted rearwardly a distance corresponding to the length of the light source in the optical axis direction thereof from the rear end of the light source and a position shifted forwardly a distance corresponding to the length of the light source in the optical axis direction thereof from the front end of the light source.

A third reflection area is located on the bottom of the inclined surface, the focus of a parabola consisting of a section of the third reflection area in the inclined surface is identical with the focus of the parabola consisting of a section of the second reflection area in the inclined surface, and the focus of a section obtained when the third reflection area is cut in the vertical surface including the optical axis of the reflector is located in the vicinity of or in front of the front end of the light source.

A fourth reflection area is located on the bottom of a horizontal surface including the optical axis of the reflector, the focus of a parabola consisting of a section obtained when the fourth reflection area is cut in the vertical surface including the optical axis of the reflector is identical with the focus of the parabola consisting of the section of the third reflection area in the vertical surface, and the focus of a parabola consisting of a section obtained when the fourth reflection area is cut in the horizontal surface including the optical axis of the reflector is identical with the focus of the parabola consisting of the section of the first reflection area in the horizontal surface.

According to the invention, the focal positions of the sections (parabolas) of the reflector in mutually adjoining reflection areas can be made to coincide with one another, and in the three planes serving as the boundaries of the four reflection areas, that is, in the horizontal surface, vertical surface and inclined surface respectively including the optical axis of the reflector, the boundary lines of the mutually adjoining reflection areas can be continuous with one another, thereby eliminating the possibility of stepped portions being formed at the boundaries of the reflection areas. This prevents generation of unnecessary light which causes glare or the like.

DESCRIPTION OF THE PREFERRED EMBODIMENTS

A description now will be given of a reflector for use in a vehicular headlight according to the invention by way of preferred embodiments.

Figure 1:
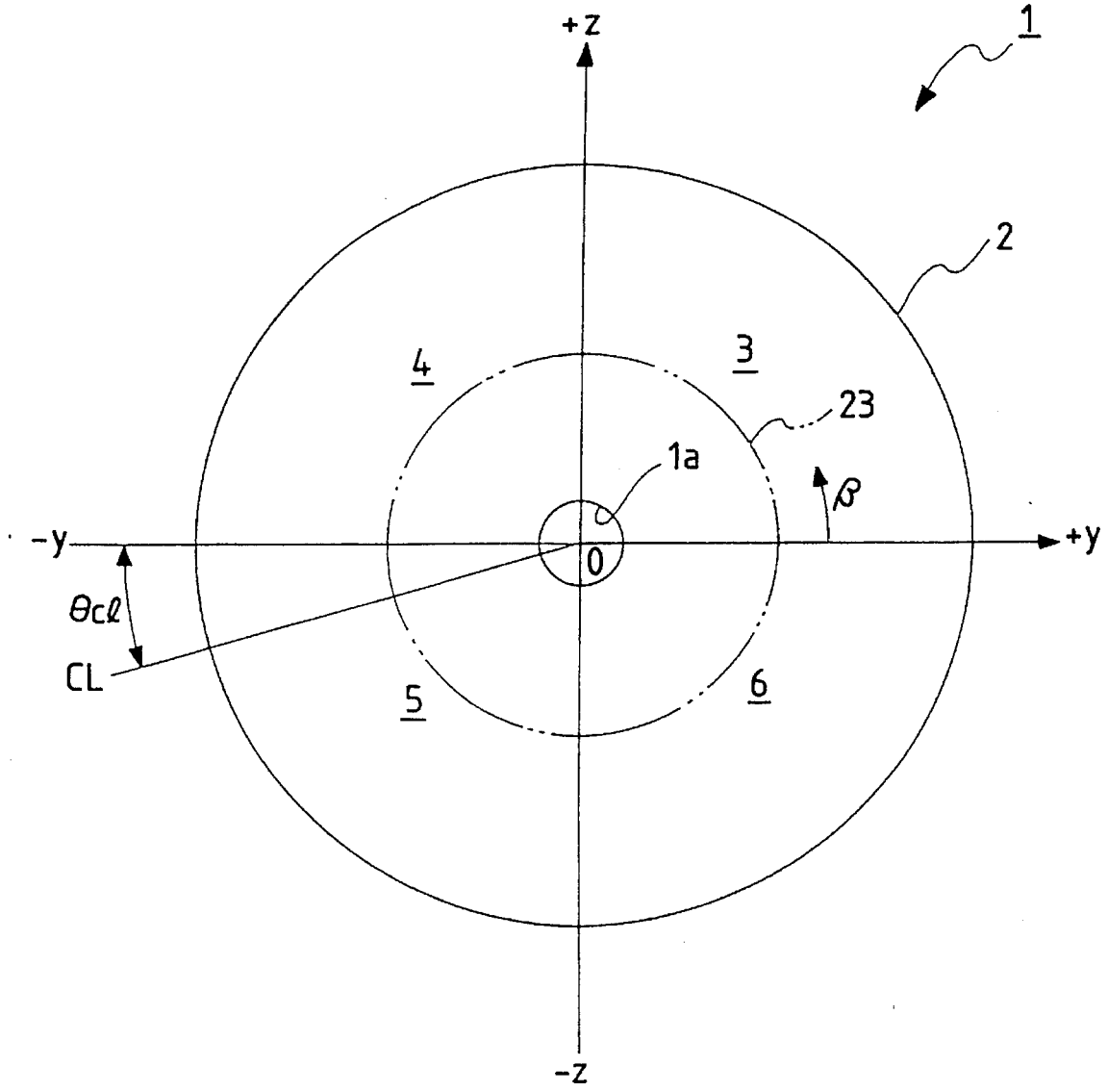
FIG. 1 is a front view of the structure of a reflection surface according to the invention.
Figure 2A:
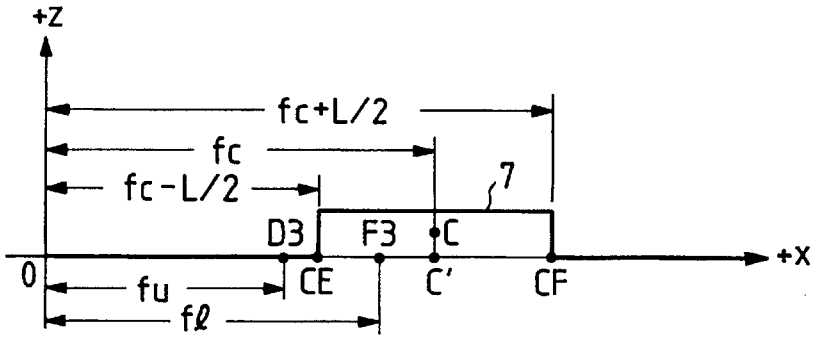
FIG. 2(*a*) is a view of a positional relation between the focuses of a reflection area 3 and a filament, FIG. 2(*b*) indicates the positional relation between the focuses of a reflection area 4 and the filament, FIG. 2(*c*) depicts the positional relation between the focuses of a reflection area 5 and the filament, and FIG. 2(*d*) shows the positional relation between the focuses of a reflection area 6 and the filament.
Figure 2B:
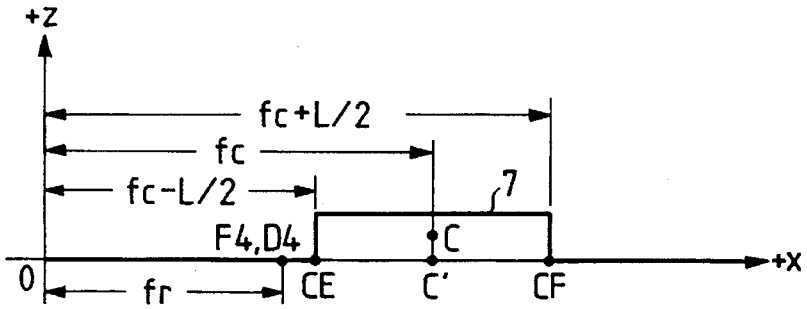
Figure 2C:
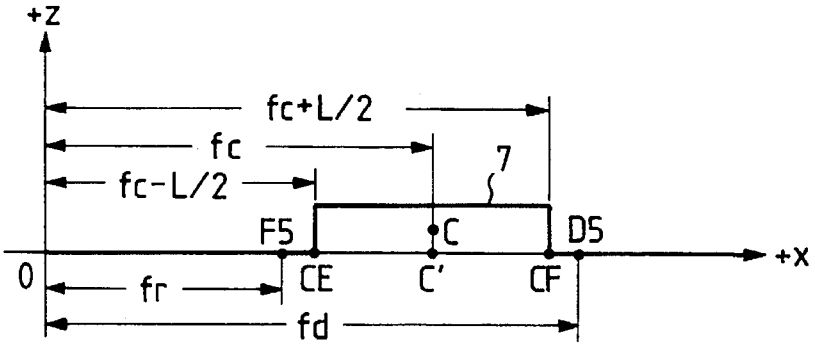
Figure 2D:
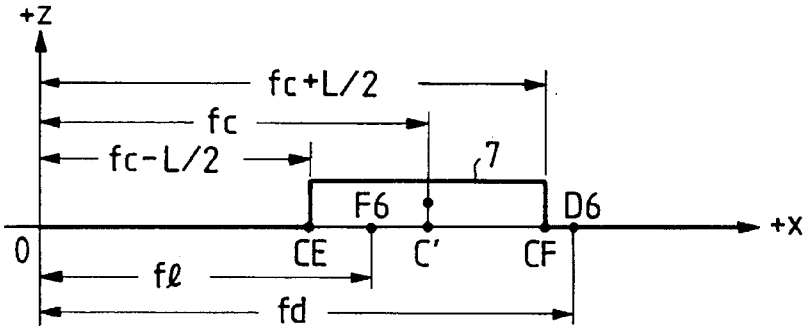

FIG. 1 is a front view of a reflector 1 including a reflection surface 2 which is divided into four reflection areas 3, 4, 5 and 6 as light distribution blocks.

Referring to a coordinate system relating to the reflection surface 2, the optical axis of the reflector 1 is selected as the x axis (in FIG. 1, the x axis extends in a direction perpendicular to the surface of the drawing sheet, with direction extending toward the viewer being the positive direction), an axis lying at a right angle to the x axis and extending horizontally is selected as the y axis (in FIG. 1, the rightward direction thereof is the positive direction), and an axis lying perpendicular to the x axis and extending vertically is selected as the z axis (in FIG. 1, the upward direction is the positive direction). When the reflection surface is viewed from the front side thereof, the origin 0 of the orthogonal coordinate system is located at the center of a light mounting hole 1*a*.

A reflection area 3, when the reflection surface is viewed from the front side thereof, is an area of a substantially quadrilateral shape located in the first quadrant (y>0, z>0) of the y-z plane.

A reflection area 4 is a fan-shaped area which is defined by an inclined surface CL inclined at a given angle ($\theta_{c1}$) with respect to the x-y plane and by the x-z plane, and, when the reflection surface is viewed from the front side thereof, extends over the second quadrant (y<0, z>0) and third quadrant (y<0, z<0) of the y-z plane with a central angle of 105°.

A reflection area 5, when the reflection surface is viewed from the front side thereof, is a fan-shaped area located in the third quadrant of the y-z plane with a central angle of 75°.

A reflection area 6, when the reflection surface is viewed from the front side thereof, is a substantially quadrilaterally shaped area located in the fourth quadrant (y>0, z<0) of the y-z plane.

These reflection areas are made continuous with their adjoining areas with no difference in level (no stepped portion) at the boundaries of the adjoining areas. The angle θcl of the boundary line between the areas 4 and 5 formed with respect to the y axis is set equal to the desired cut line angle.

The shape of the basic surface of the reflection areas 3 to 6 has previously been disclosed by the present applicants (see Japanese Patent Application No. Hei. 3-23830), and, have a description will be given below is simply an outline of the basic surface.

Figure 3:
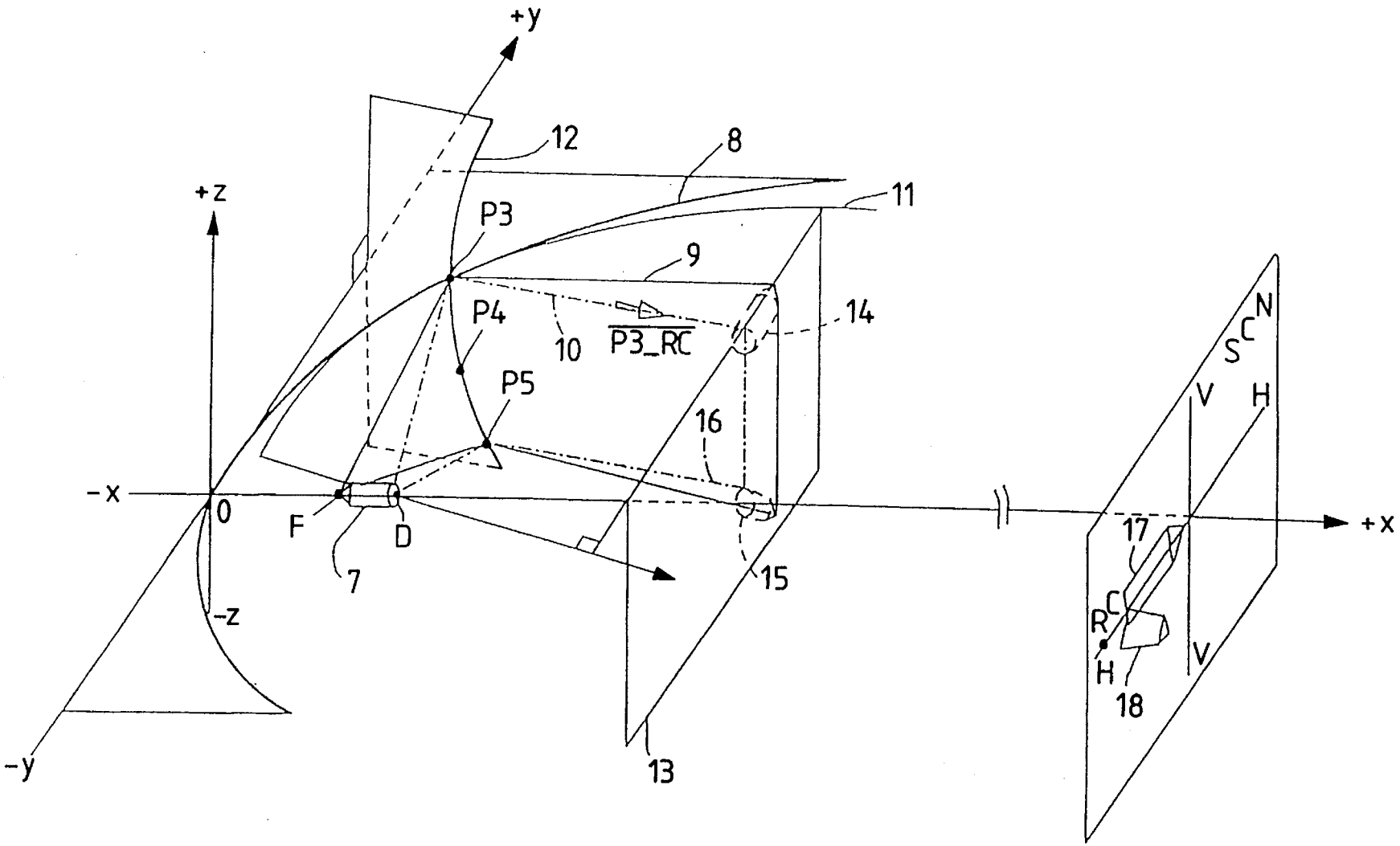
FIG. 3 is an optical path view of a basic surface according to the invention.

In FIG. 3, a filament 7 is disposed such that the central axis thereof extends along the x axis and is interposed between a point F (first focus) and a point D, which is a point (second focus) shifted a distance d in the positive direction of the x axis from the point F. In order to facilitate the definition of the direction of the filament 7, the filament 7 is assumed to have a pencil-like shape such that the end portion thereof at the point F side is pointed and the end portion thereof at the point D side is formed as a flat surface.

At first, in the x-y plane, there is assumed a parabola 8 with the point F as its focus. A ray 9 emitted from the point F in the vicinity of the rear end of the filament 7 is reflected at a point P3 on the parabola 8, and then is emitted in a direction parallel to the x axis.

Also, a ray emitted from the point D near the front end of the filament 7 is reflected at the point P3, is then emitted toward a point RC on a screen SCN located in the distance, providing a ray 10 intersecting the optical axis (that is, a ray having a vector P3_RC as a direction vector).

Another parabola 11 is assumed which includes an optical axis parallel to the vector P3_RC and has the point D as its focus. In FIG. 3, the parabola 11 is inclined at the point P3 with respect to the parabola 8.

If the parabola 11 is revolved about the optical axis thereof, a paraboloid of revolution is obtained. By cutting the paraboloid of revolution by a plane including the vector P3_RC and lying at right angles to the x-y plane, there is obtained a parabola 12.

By moving the point P3 along the parabola 8, there is obtained a plurality of parabolas 12. Thus there can be generated a curved surface which consists of an aggregate of the parabolas 12.

Referring to images which are projected on a surface 13 in the intermediate stage before the filament images are projected on the screen SCN, an image 14 formed through the point P3 is parallel to a horizontal line H—H, an image 15 formed through a point P5 located on the parabola 12 below the point P3 forms a certain angle with respect to the horizontal line H—H, and the ray 10 emitted from the point D and reflected at the point P3 is parallel to a ray 16 emitted from the point D and reflected at the point P5.

In other words, since the shapes of the intersecting lines are controlled such that the rays relating to the flat end portions of the filament images 14 and 15 are parallel to each other, filament images 17 and 18 are positioned in such a manner that a point RC where these parallel rays coincide with each other in the distance is the center of revolution thereof.

Figure 4:
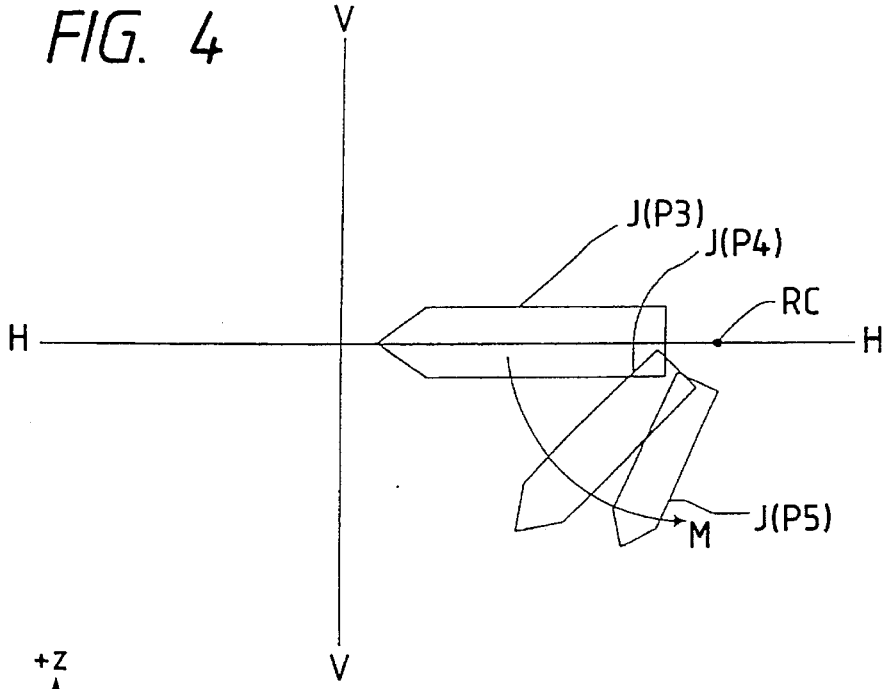
FIG. 4 is a schematic view used to explain the arrangement of filament images according to the basic surface of the invention.

FIG. 4 shows generally the arrangement of filament images formed through a point P4 situated on the parabola 12 between the points P3 and P5.

In FIG. 4, J(X) designates a filament image which corresponds to each point X (X=P3, P4, P5) shown in FIG. 3, and filament images J(P3), J(P4) and J(P5) formed through the points P3, P4 and P5 respectively, are positioned with the point RC on the horizontal line H—H as the center of revolution thereof.

That is, the filament images, as shown by an arrow M, are rotated counterclockwise about the point RC as the reflection point is moved along positions such as P3→P4→P5, and the filament images are positioned below the horizontal line H—H in such a manner that the flat end portions of the filament images always face the point RC.

Figure 5:
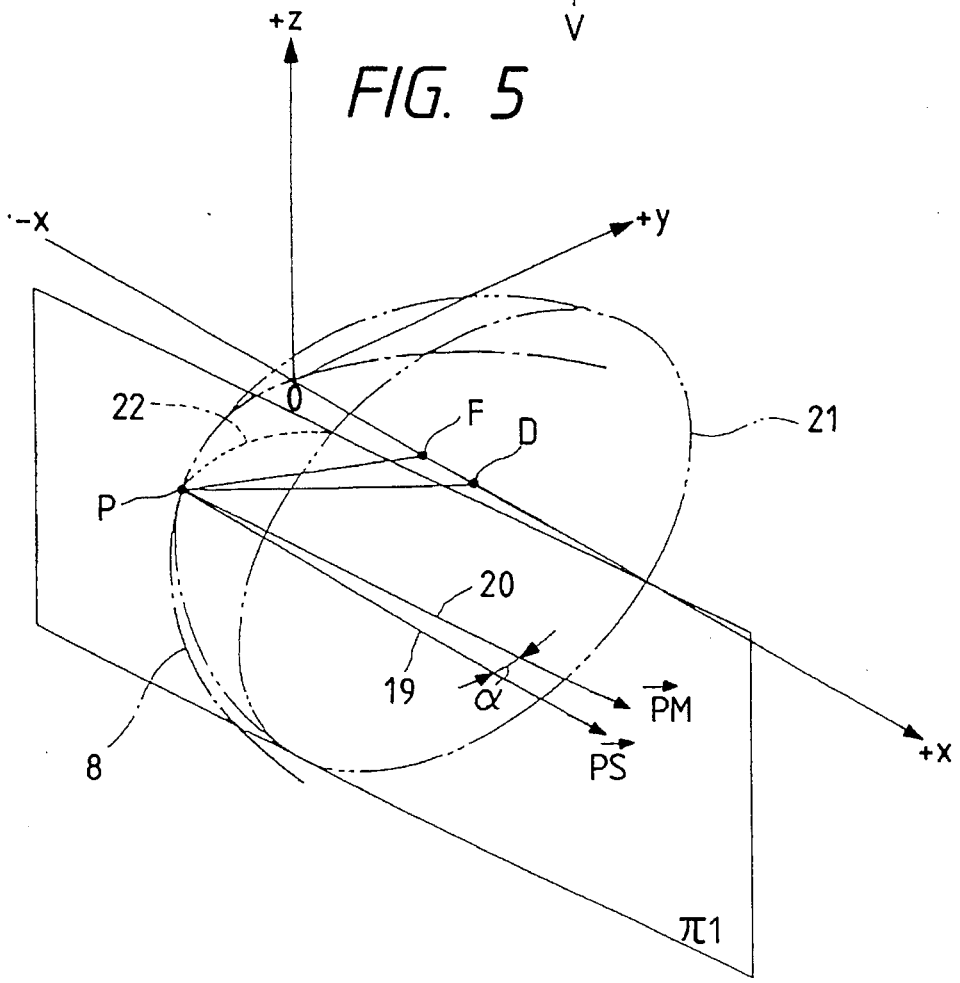
FIG. 5 is a schematic perspective view used to explain the basic surface according to the invention.

FIG. 5 illustrates the formation of the basic surface. In FIG. 5, a point P designates an arbitrary point located on the parabola 8 in the x-y plane (by introducing a parameter q, the coordinates of the point P can be expressed as P ($q^2/f$, $-2q$, 0). If a ray emitted from the point F is reflected at the point P, then the reflected ray 19 travels straight in parallel to the x axis (the traveling direction thereof is shown by a vector PS).

Also, a ray 20 emitted from the point D and reflected at the point P is reflected at an angle of reflection smaller than the ray 19 according to the law of reflection and travels straight at an angle (which is expressed as $\alpha$) with respect to the ray 19 (the traveling direction thereof is shown by a vector PM).

A virtual paraboloid of revolution 21 (shown by a two-dot chain line), is assumed which has the point D as its focus and includes an optical axis lying parallel to the ray vector PM, which passes through the point P. Let us consider a section (that is, an intersection line 22 between the paraboloid of revolution 21 and plane $\eta$1) obtained when the paraboloid of revolution 21 is cut by a plane (which is designated by $\eta$1) including the ray vector PM and lying parallel to the z axis.

Not only the section (which is shown by a broken line) has a paraboloidal shape, but also the section matches the state shown in FIG. 3 in view of the fact that rays emitted from the point D and then reflected at an arbitrary point on the intersection line 22 are parallel to each other.

In this manner, the intersection lines between a virtual paraboloid of revolution corresponding to an arbitrary point P on the parabola 8 and planes parallel to the optical axis of the virtual paraboloid of revolution and also passing through the point P and parallel to the z axis are combined to thereby provide the basic surface.

If the basic surface or curved surface is expressed according to a parametric representation method using the parameters shown in Table 1, there is obtained formula 1 below.

TABLE 1

| Definition of parameters | |
|---|---|
| Parameter | Definition |
| f | Focal distance of parabola 8 (OF) |
| d | Distance between point F and point D (FD) |
| q | Specified point on parabola 8. |
| h | Height in z direction with surface z = as reference |
| Q | $= (f^2 + q^2)/f$ |

$$x = \frac{(Q-f)\left[1 + \frac{2d(Q-f)}{Q^2 + (2f-Q)d}\right] + \frac{h^2}{4f(1+d/Q)}}{1 + \frac{2d(Q-f)}{Q^2 + (2f-Q)d}} \quad (1)$$

$$y = 2q\left[\frac{d(x-Q+f)}{Q^2 + (2f-Q)d} - 1\right]$$

where $$z = h$$

$$Q = \frac{f^2 + q^2}{f}$$

Formula 1 is derived from only the above description and elementary algebraic geometry.

Also, it can be seen that the formula 1 includes the paraboloid of revolution as a special case when d=0.

If formula 1 is generalized with the above-mentioned parabola 8 as a parabola on a surface revolved about the optical axis at an angle of $\theta$ from the x-y plane, then formula 2 is obtained.

$$x = x(q,h,f,d,\theta) = \frac{(Q-f)\left[\frac{d}{Q} + \cos^2\theta\left(1 - \frac{d}{Q} + \frac{2d(Q-f)}{Q^2+(2f-Q)d}\right)\right] + \frac{h^2}{4f(1+d/Q)}}{1 + \frac{2d(Q-f)\cos^2\theta}{Q^2+(2f-Q)d}} \quad (2)$$

$$y = y(q,f,d,\theta) = 2q \cdot \cos\theta\left[\frac{d(x-Q)}{Q^2+(2f-Q)d} - 1\right]$$

$$z = z(h) = h$$

$$\text{where } Q = \frac{f^2+q^2}{f}$$

Formula 2 includes the formula 1, which can be clearly understood if θ=0 in formula 2.

Referring now to FIG. 2, there is shown the positional relation between the cylindrical filament 7 and the focuses of the reflection areas 3, 4, 5 and 6. The filament 7 is set on top of the x axis as to be in contact with the x axis, and the central axis of the filament 7 extends parallel to the x axis.

In FIGS. 2(*a*)–2(*d*), a point C designates the central point of the filament 7 and a point C' ($f_c$, 0, 0) corresponds to a point of intersection between the x axis and the foot of a perpendicular line drawn from the point C down onto the x axis. If the longitudinal length of the filament 7 is expressed as L, then the projection of the filament 7 on the x axis occupies a range extending between a point CE ($f_c$–L/2, 0, 0) and a point CF ($f_c$+L/2, 0, 0).

In particular, FIG. 2(*a*) shows the positional relation between the focuses of the reflection area 3 and the filament 7, in which the first focus $F_3$ ($f_1$, 0, 0) of the reflection area 3 is located on the x axis between the point C' and the point CE, and the second focus $D_3$ ($f_u$, 0, 0) thereof is located at a position slightly rearward of the point CE. That is, in this case, d<0.

FIG. 2(*b*) shows the positional relation between the focuses of the reflection area 4 and the filament 7, in which the first focus $F_4$ ($f_r$, 0, 0) thereof is identical with the second focus D4 thereof, and the two focuses coincide with the above-mentioned point $D_3$ ($f_r$=$f_u$). That is, d=0.

FIG. 2(*c*) shows the positional relation between the focuses of the reflection area 5 and the filament 7, in which the first focus $F_5$ is identical with the above points $F_4$ and $D_4$, and the second focus $D_5$ ($f_d$, 0, 0) thereof is located at a position shifted slightly forwardly from the point CF. That is, in this case, d>0.

FIG. 2(*d*) shows the positional relation between the focuses of the reflection area 6 and the filament 7, in which the first focus $F_6$ is identical with the above point $F_3$ and the second focus $D_6$ is identical with the above point $D_5$. In this case, d>0.

The reflection area 3 is a reflection surface obtained when f=$f_1$ and d=$f_u$–$f_1$ in formula 1. The section thereof obtained when the reflection area 3 is cut by a vertical surface including the x axis is a parabola having a focal distance $f_u$, and the section thereof when cut by a horizontal surface including the x axis is a parabola having a focal distance $f_1$.

The reflection area 4 is a reflection surface having f=$f_u$ and d=0 in formula 1, that is, a paraboloid of revolution. Here, in the reflection area 4, it is not always necessary to make the point $F_4$ coincide with the point $D_4$, but the two focuses can be positioned on the x axis at a distance of the order of several millimeters from each other. The reflection area 5 is a reflection surface for which f=$f_r$, d=$f_d$–$f_r$ and θ=$\theta_{c1}$ in formula 2, a section of the reflection area 5 obtained when it is cut by the inclined surface CL is a parabola having a focal distance $f_r$, and a section thereof when it is cut by the vertical surface including the x axis is a parabola having a focal distance $f_d$.

The reflection area 6 is a reflection surface having f=$f_1$ and d=$f_d$–$f_1$ in formula 1, a section of the reflection area 6 obtained when it is cut by the vertical surface including the x axis is a parabola having a focal distance $f_d$, and a section thereof obtained when it is cut by the horizontal surface including the x axis is a parabola having a focal distance $f_1$.

The conditions of the parameters are as set forth in Table 2.

TABLE 2

| Structure of reflection surface | | | |
|---|---|---|---|
| Reflection areas | Range (β) | d | θ |
| 3 | 0°–90° | $f_u$–$f_1$ | 0 |
| 4 | 90°–195° | 0 | 0 |
| 5 | 195°–270° | $f_d$–$f_r$ | $\theta_{c1}$ |
| 6 | 270°–360° | $f_d$–$f_1$ | 0 |

FIGS. 6 to 9 show generally the tendency of arrangement of filament images in the respective reflection areas. These figures show filament images which, as shown in FIG. 1, are projected in front of the reflection surface 2 by means of several representative points selected on an intersection line between a virtual cylinder having the x axis as its central axis and the reflection surface 2. In FIG. 1, reference character β designates an angle parameter which has, as its positive direction, a counterclockwise direction with the y axis as a reference when viewed from the front side of the reflection surface 2. Also, in FIGS. 6 to 9, the line H—H shows a horizontal line, the line V—V is a vertical line, and a point o indicates a point of intersection between the two lines.

Figure 6:
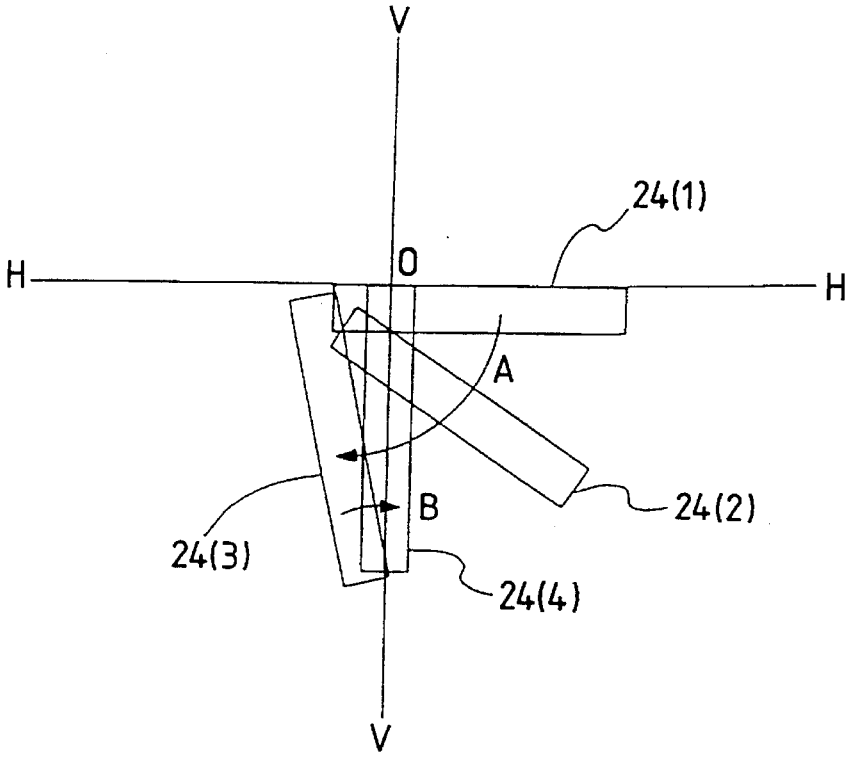
FIG. 6 is a schematic view for explaining the tendency of arrangement of filament images formed by a reflection area 3.

In particular, FIG. 6 shows the tendency of arrangement of the filament images formed by the reflection area 3 and, in FIG. 6, rectangular images 24 (i) (i=1–4) are shown as typical examples of such filament images.

As shown in FIG. 6, the central axis of the filament image 24 (1) corresponding to β=0° extends parallel to the horizontal line H—H and, as the value of β increases, the filament images 24 (2) and 24 (3) are rotated clockwise, as shown by an arrow A, and the filament image 24 (3) is rotated beyond a vertical line V—V, being located on the left of the vertical line V—V. If the value of β increases further, then the image is rotated toward the vertical line V—V as shown by an arrow B, and thus the filament image 24 (4) corresponding to β=90° is located such that the central axis thereof extends in the vertical direction.

Figure 7:
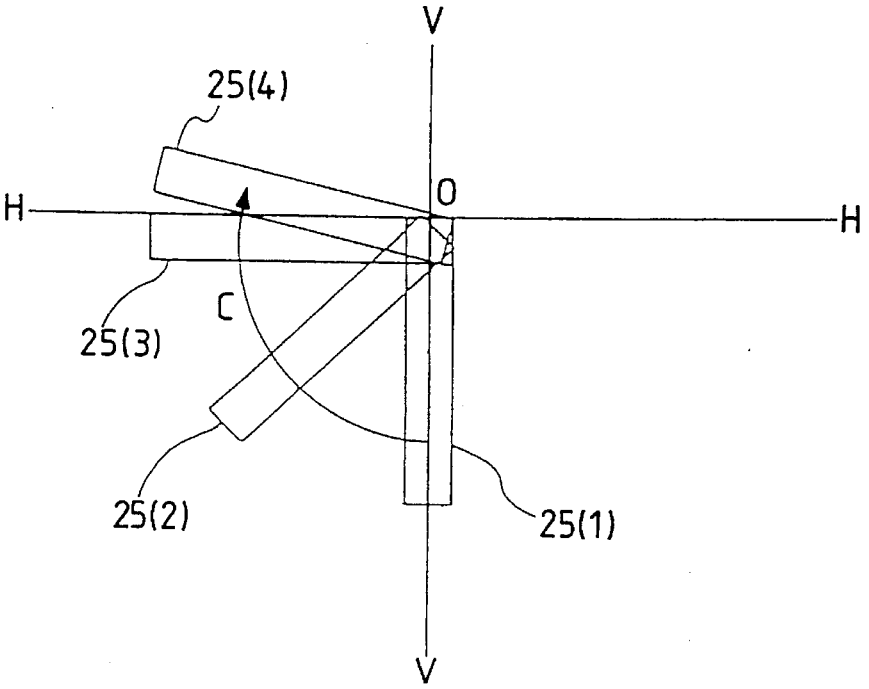
FIG. 7 is a schematic view used to explain the tendency of arrangement of filament images formed by a reflection area 4.

FIG. 7 shows the tendency of arrangement of filament images formed by the reflection area 4, and rectangular images 25 (i) (i=1–4) shown in FIG. 7 are typical examples of the filament images.

As can be seen clearly from the fact that the reflection area 4 is formed as a paraboloid of revolution as described above, the filament images 25 (i) are arranged radially around a central point of rotation o, and the filament images are rotated clockwise, as shown by an arrow C, from the filament image 25 (1) (which corresponds to the filament image 24 (4)) as the value of β increases. Here, the filament image 25 (4) protruding beyond the horizontal line H—H contributes to formation of a cut line inclined with respect to the horizontal line H—H.

Figure 8:
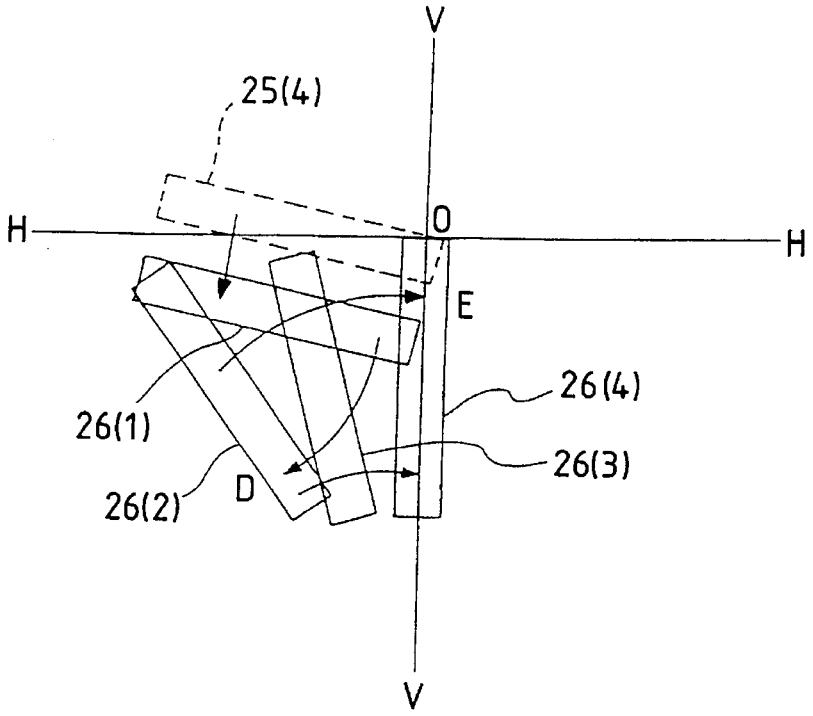
FIG. 8 is a schematic view used to explain the tendency of arrangement of filament images formed by a reflection area 5.

FIG. 8 shows the tendency of arrangement of filament images formed by the reflection area 5, and rectangular images 26 (i) (i=1–4) shown in FIG. 8 are typical examples of the filament images.

As shown in FIG. 8, after the filament images are suddenly moved in parallel from the filament image 25 (4) shown by a broken line to the filament image 26 (1), the filament image is rotated clockwise as the value of β increases, as shown by an arrow D, reaching the filament image 26 (2). Then, the filament image is rotated clockwise like the filament images 26 (3) and 26 (4), as shown by an arrow E. Here, the filament image 26 (4) corresponds to β=270°, and is positioned such that the central axis thereof extends in the vertical direction.

Figure 9:
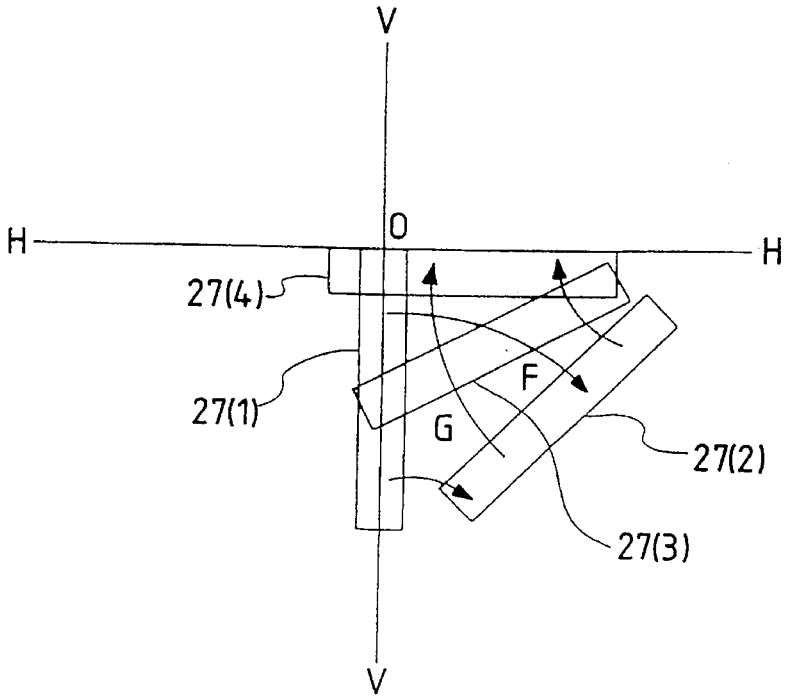
FIG. 9 is a schematic view used to explain the tendency of arrangement of filament images formed by a reflection area 6.

FIG. 9 shows the tendency of arrangement of filament images by means of the reflection area 6, and rectangular images 27 (i) (i=1–4) shown in FIG. 9 are typical examples of the filament images.

As shown by an arrow F in FIG. 9, with the filament image 27 (1) (which corresponds to the filament image 26 (4)) as the starting image, the filament image is rotated clockwise to the filament image 27 (2) as the value of β increases, and then the filament image is rotated in the order of the filament images 27 (3) and 27 (4), as shown by an arrow G. Here, the filament image 27 (4) corresponds to the filament image 24 (1), and is positioned such that the central axis thereof extends horizontally.

Figure 10:
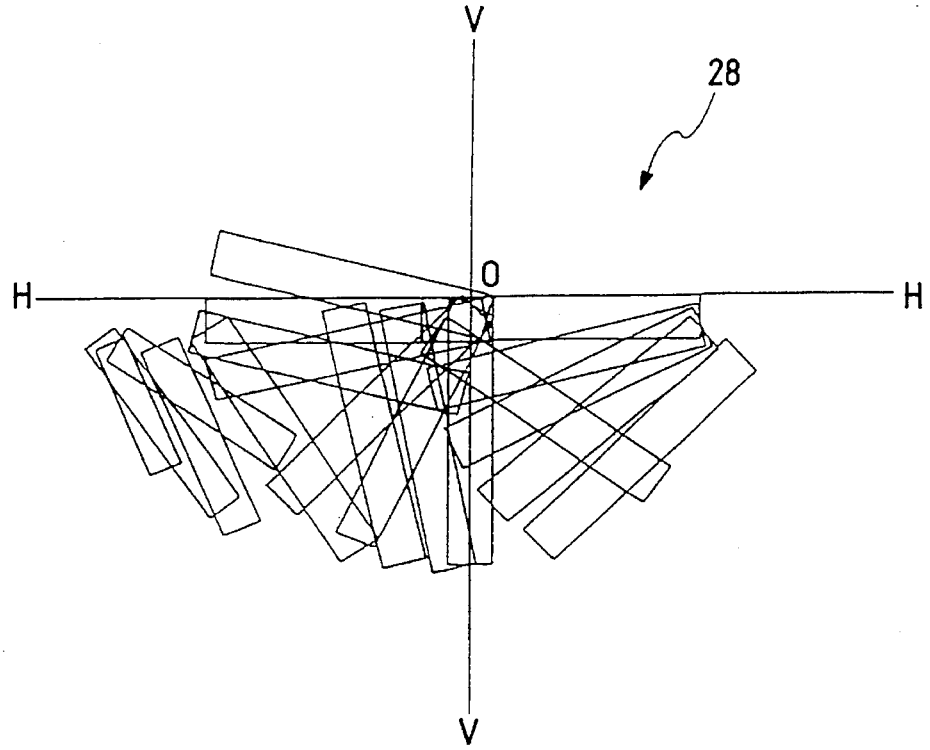
FIG. 10 is a schematic view of a composite pattern of the reflection areas 3 to 6.

FIG. 10 shows generally a pattern 28 obtained by composing the representative filament images including the above-mentioned filaments. In this pattern 28, only part of the filament images projected by the reflection area 4 (that is, the part that contributes to formation of an inclined cut line) extends over the top side of the horizontal line H—H, while the remaining filaments are all situated under the horizontal line H—H. As shown in FIG. 10, it can be seen that the portions of the pattern 28 on the left of the vertical line V—V are spread more greatly than the portions thereof on the right of the vertical line V—V.

Conditions necessary to position the filament images by the reflection areas 3 and 6 under the horizontal line H—H are as follows:

Condition (1): $f_u<f_c-L/2$

Condition (2): $f_d>f_c+L/2$

Condition (3): $f_u-L\leqq f_1\leqq f_d+L$

Also, the following is a condition necessary to move the one-side end portions of the filament images by the reflection areas 3 and 6 to the vicinity of an intersection point between the horizontal line H-H and vertical line V—V (see the filament images 24 (1) to 24 (3) shown in FIG. 6 and the filament image 27 (4) shown in FIG. 9).

Condition (4): $f_c-L/2\leqq f_1\leqq f_c+L/2$

Here, if $f_1<f_u$ or $f_1>f_d$, then there light is obtained which is diffused horizontally.

The following is a condition necessary to control the horizontal light in connection with the reflection areas 4 and 5:

Condition (5): $f_c-L\leqq f_r\leqq f_c+L$

The projection pattern 28 forms an original form of a light distribution pattern, and it is necessary to diffuse the pattern 28 in the horizontal direction and form a cut line for the pattern 28 by some method.

In this operation, according to the conventional headlight, there is employed a method in which a lens step having a diffusion action is formed in an outer lens disposed in front of the reflector 1. However, as the inclination of the outer lens is increased, it becomes difficult to form lens steps having a sufficiently great horizontal diffusion action, and, therefore, there arises the need to shift the diffusion action to the reflector 1.

In view of this, according to the invention, there is employed a method in which a set of equations representing wavy patterns are prepared, and these equations are combined with a curved surface equation relating to the reflection surface 2 to thereby obtain a reflection surface 2 which wave smoothly, so that the light can be diffused only by the action of the reflector.

For this purpose, the following function is defined:

$$\mathrm{Aten}(s,W)=\exp\left[-\left(\frac{2s}{W}\right)^2\right]$$

Figure 11:
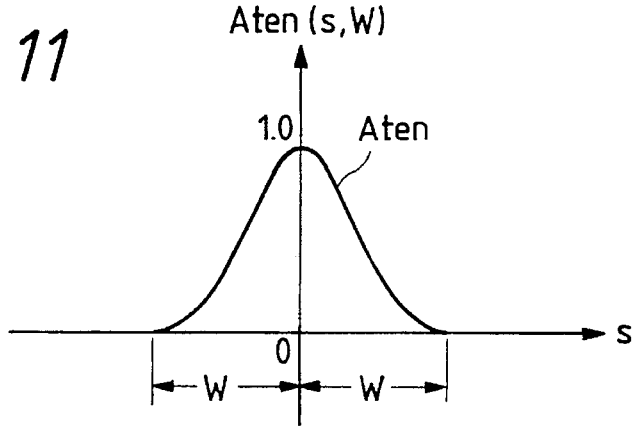
FIG. 11 is a schematic view of a normal distribution type function Aten(s, λ)

In a normal (Gaussian) distribution type function Aten(s, W), the parameter W designates the degree of attenuation. In FIG. 11, there is shown the shape that is represented by this function.

A periodic function WAVE(s,λ) using a parameter λ as shown in the following formula 4 will now be considered.

$$\mathrm{WAVE}(s,\lambda)=\frac{1-\cos\left(360^\circ\cdot\frac{s}{\lambda}\right)}{2} \tag{4}$$

Figure 12:
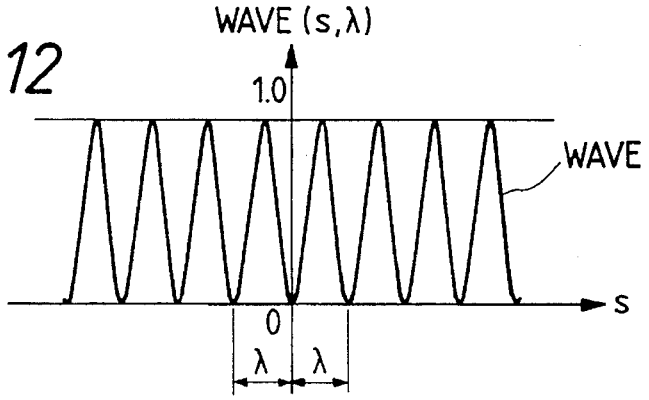
FIG. 12 is a schematic view of a periodic function WAVE(s, W)

In formula 4, the parameter λ expresses the wavelength of a cosine wave, that is, the distance between waves. The shape imposed by function WAVE is shown in FIG. 12. In this example, as the periodic function, a cos (cosine) function is used, however, other periodic functions can also be used as well.

Figure 13:
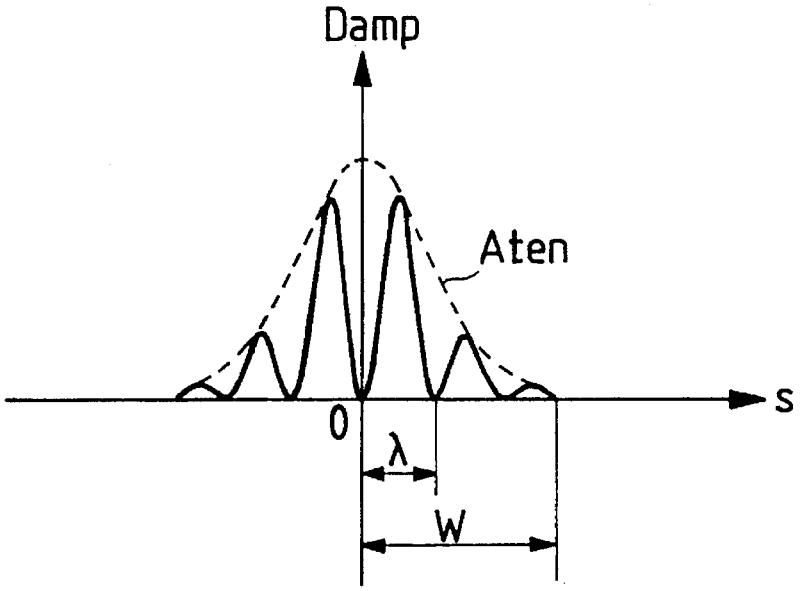
FIG. 13 is a schematic view of a damp periodic function Damp(s, λ)

When these functions are multiplied together, then there is obtained a damped periodic function Damp as shown in FIG. 13, and, in accordance with the function Damp, the reflection surface 2 can made wavy.

Figure 14:
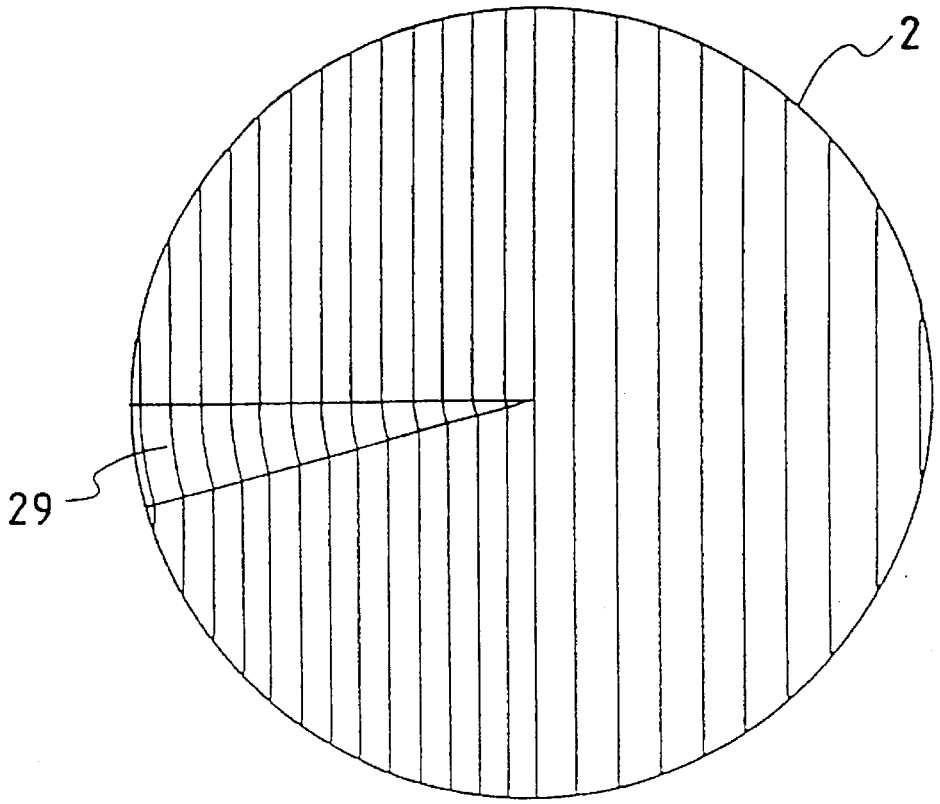
FIG. 14 is a schematic front view of an example of cases in which the reflection surface is made wavy.

FIG. 14 is a front view of an example of cases in which the reflection surface 2 is made wavy, and, in FIG. 14 there are shown diagrammatically the projected portions of waves or undulations formed in the reflection surface 2.

As shown in FIG. 14, an area block relating to the waved portion is not identical with the area block of the reflection surface 2, but a fan-shaped area 29 (that is, an area of β=180°–195°) on the bottom of the x-y plane, and the vicinity of the reflection area 4 has a circular wave pattern having the origin o as the center thereof, whereas the remaining areas of the reflection area 4 contain plane waves which spread in the horizontal direction.

Figure 15:
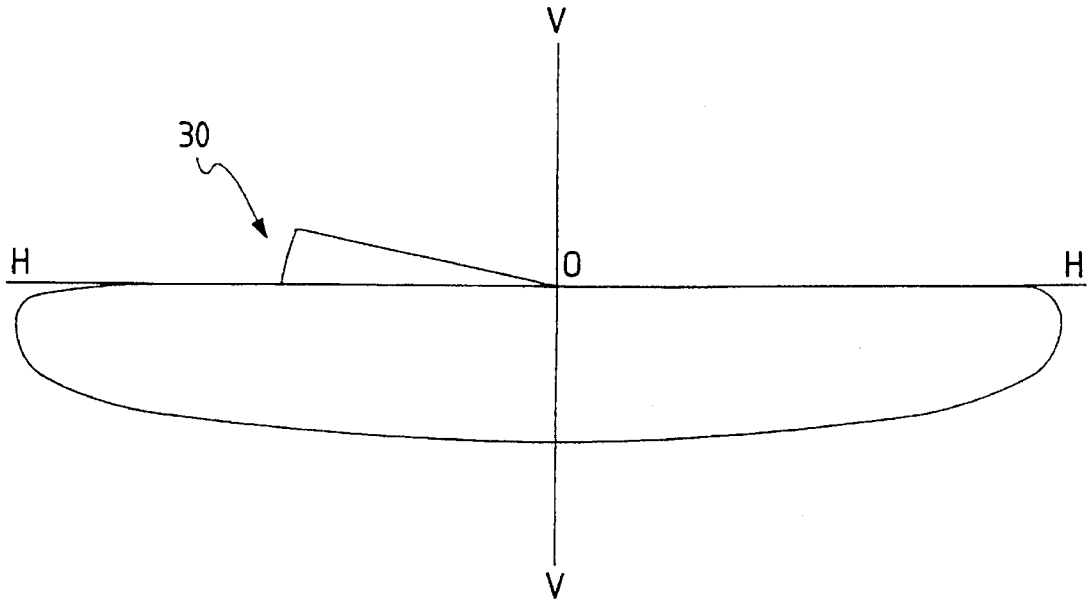
FIG. 15 is a schematic view of a projection pattern formed by the reflection surface.

FIG. 15 shows schematically a projection pattern 30 of the reflection surface 2 obtained by the above-mentioned waving operations. This shows that a pattern approximate to the stipulated light distribution pattern can be formed only by the action of the reflection surface 2.

Figure 16:
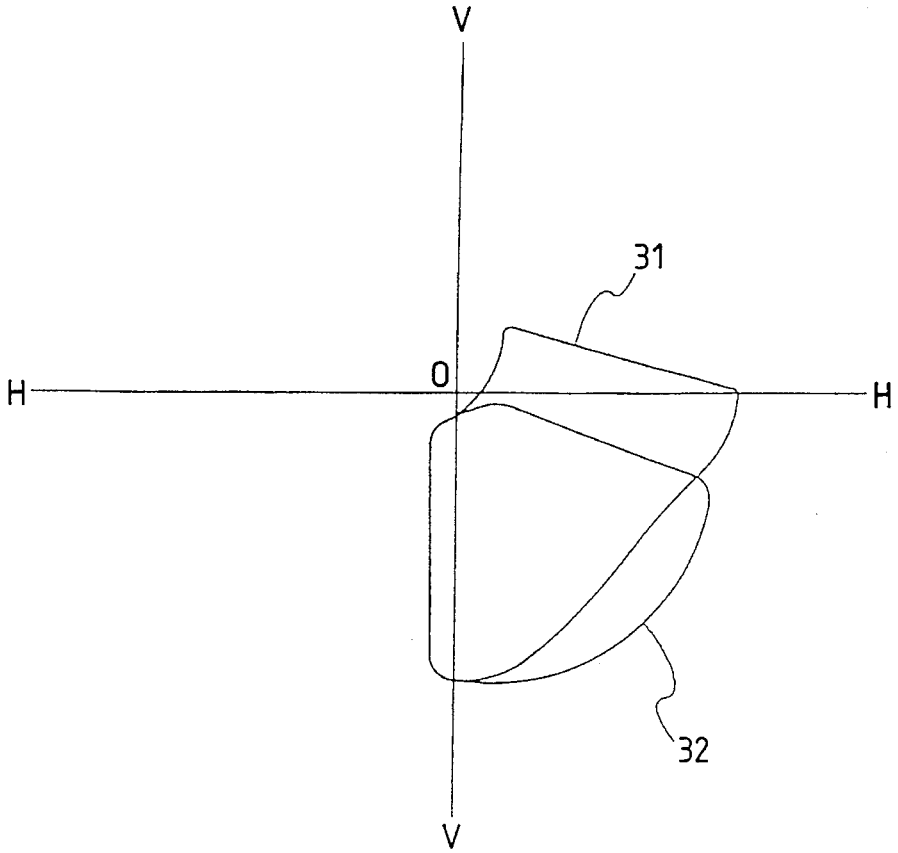
FIG. 16 is a schematic view used to explain a relation between projection patterns and a positional relation between the focuses of parabolas and a filament in a boundary between the second and third reflection areas.

According to the above-mentioned reflector 1, since the arrangement of the filament images can be controlled according to the positional relation between the filament 7 and the first and second focuses, for example, if $f_r=f_c+L/2$, then projection patterns 31 and 32 formed respectively by the reflection areas 4 and 5 are situated substantially to the right of the vertical line V—V, as shown in FIG. 16. The portion of the projection pattern 31 formed by the reflection area 4 nearer to the upper edge thereof is positioned above the horizontal line H—H.

Figure 17A:
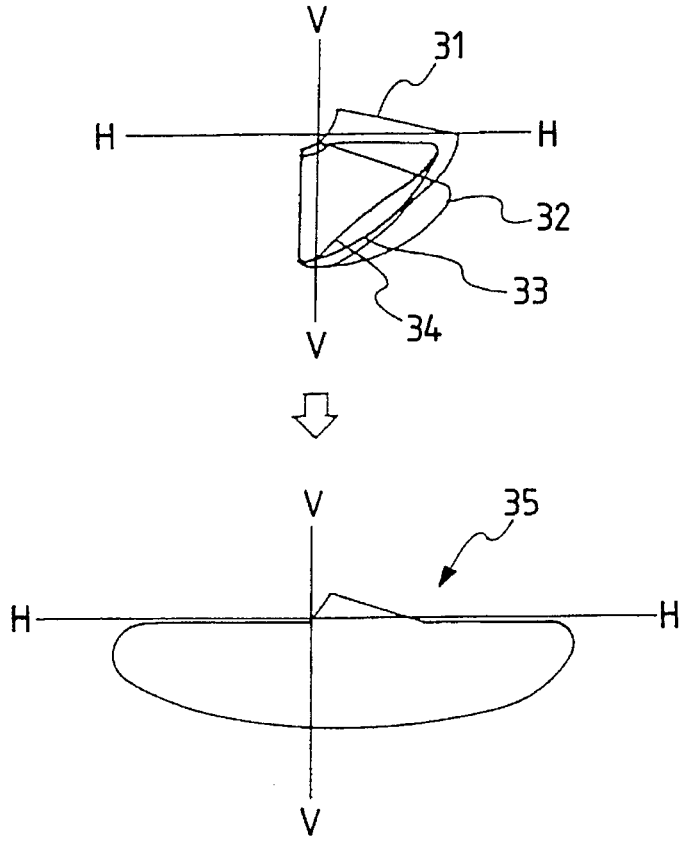
FIGS. 17(*a*) and 17(*b*) are schematic view of another example of cases in which the reflection surface is made wavy, of which FIG. 17(*a*) is a schematic view of variations in the composite pattern before and after diffusion control by means of the wavy reflection surface when the projection patterns shown in FIG. 16 are composed of the projection patterns formed by the first and fourth reflection areas, and FIG. 17(*b*) is a schematic front view of the reflection surface.
Figure 17B:
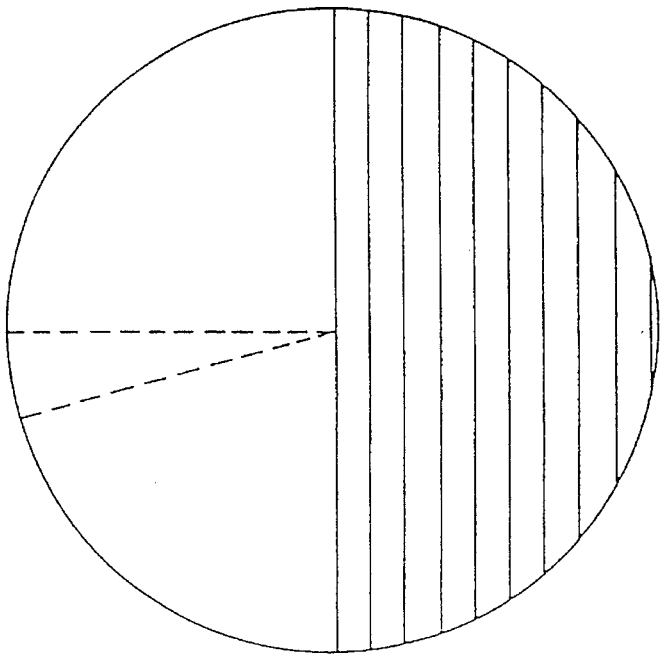

FIG. 17(*a*) shows schematically a composite pattern composed from the projection patterns 31 and 32 and projection patterns 33 and 34 respectively formed by the reflection areas 3 and 6, in which, if $f_1=f_u$, then all patterns are situated almost on the right of the vertical line V—V.

Therefore, as shown in FIG. 17(*b*), if plane waves spreading horizontally are formed in the reflection areas 3 and 6 whereas no waving operation is performed on the reflection areas 4 and 5 (it is necessary that no waving operation be performed in at least an area of $\beta=180°-195°$), then the projection patterns 33 and 34 are diffused horizontally, so that there can be obtained the pattern 35 (which is appropriate for use in the U.S.) shown in FIG. 17(*a*).

As described above, by setting the positional relation between the filament 7 (light source) and focuses for all reflection areas, the arrangement of the projection patterns can be controlled relatively freely.

As can be seen clearly from the foregoing description, according to the invention, the reflection surface is divided into four reflection areas by three planes serving as the boundaries of the reflection areas, that is, a horizontal surface, a vertical surface and an inclined surface respectively including the optical axis of the reflector, and the focal positions of the sections (parabolas) in the mutually adjoining reflection areas are made to coincide with each other and the respective boundary lines of the four reflection areas are made continuous with one another, thereby eliminating the possibility of a level difference (or a stepped portion) being formed. This in turn prevents glare from being increased or light unnecessary in forming a light distribution pattern from being produced due to light reflected at the boundaries of the reflection areas.

Also according to the invention, the focuses of parabolas consisting of the sections of the first and fourth reflection areas in the horizontal surface are positioned between the front and rear ends of a light source, whereby part of the projection images of the light source projected on a screen disposed in front of the reflection surface by the first and fourth reflection areas can be used as light which contributes to the formation of the luminous intensity central portion of a light distribution pattern.

Further according to the invention, a function consisting of the product of a normal distribution type function and a periodic function is added to a representation expression on the surfaces of the reflection areas to thereby make a given area of the reflection surface wavy, thus to control diffusion of light, whereby there is obtained a light distribution pattern for a low beam. This makes it possible to reduce the degree of dependence on the outer lens for light distribution control and thus to design a reflector which is suitable for a slant-type headlight.

The foregoing description concerns an embodiment for left-hand light distribution as an example. However, the invention is also applicable to a right-hand light distribution as well. In the latter case, the structure of the reflector should be opposite in right and left direction to each other.

What is claimed is:

1. A reflector for use in a vehicular headlight capable of forming a low beam directed in a forward direction and having a light source disposed such that a central axis of said light source extends along the optical axis of said reflector, the reflector having a reflection surface defined as follows:

a reference parabola is defined in one of a horizontal plane and a plane inclined at a given angle with respect to the horizontal plane, said horizontal plane including said optical axis of said reflector, a reference point is defined on an axis which passes through a vertex and focus of the reference parabola at a position offset from the focus of the reference parabola, ray vectors are defined each by a corresponding reflected ray obtained when a ray assumed to have been emitted from the reference point is reflected at an arbitrary reflection point on a parabola obtained by projecting the reference parabola on the horizontal plane, and said reflection surface is coincident with a collection of lines of intersection each obtained when a respective virtual paraboloid of revolution passing through the reflection point and having the reference point as its focus is cut by a plane including the respective ray vector and lying parallel to a vertical axis, said reflection surface being further characterized in being divided into four reflection areas disposed around said optical axis of said reflector by a horizontal half plane including said optical axis of said reflector, a vertical plane including said optical axis of said reflector, and an inclined half plane inclined at a given angle with respect to said horizontal half plane including said optical axis of said reflector, said horizontal half plane and said inclined half plane being on opposite sides of said vertical plane;

(a) the first reflection area is located above said horizontal half plane, the focus of a parabola defined by an intersection of said first reflection area and said vertical plane is located in one of the vicinity of and to the rear of the rear end of said light source, and the focus of a parabola defined by an intersection of said first reflection area and said horizontal half plane is located between a position shifted rearwardly a distance corresponding to the length of said light source in the optical axis direction thereof from said focus of said section in said vertical plane and a position shifted forwardly a distance corresponding to said length of said light source from the focus of a parabola defined by an intersection of the fourth reflection area and said vertical plane;

(b) the second reflection area is located above said inclined plane, the focus of a parabola defined by an intersection of said second reflection area and said vertical plane is identical with said focus of said parabola defined in (a), and the focus of a parabola defined by an intersection of said second reflection area and said inclined plane is located between a position shifted rearwardly a distance corresponding to the length of said light source in the optical axis direction thereof from the rear end of said light source and a position shifted forwardly a distance corresponding to said length of said light source from the front end of said light source;

(c) the third reflection area is located below said inclined plane, the focus of a parabola defined by an intersection of said third reflection area and said inclined plane is identical with said focus of said parabola defined in (b), and the focus of a parabola defined by an intersection of said third reflection area and said vertical plane is located in one of the vicinity of and forward of the front end of said light source; and (d) the fourth reflection area is located below said horizontal half plane, the focus of a parabola defined by an intersection of said fourth reflection area and said vertical plane is identical with said focus of said parabola defined in (c), and the focus of a parabola defined by an intersection of said fourth reflection area and said horizontal half plane is identical with said focus of said parabola defined in (a).

2. The reflector for use in a vehicular headlight as set forth in claim 1, wherein said focuses of (1) said parabola defined by an intersection of said first reflection area and said vertical plane, (2) said parabola defined by an intersection of said second reflection area and said vertical plane, (3) said parabola defined by an intersection of said third reflection area and said inclined plane, and (4) said parabola defined by an intersection of said fourth reflection area and said vertical plane are situated between the front and rear ends of said light source.

3. The reflector for use in a vehicular headlight as set forth in claim 1 or 2, wherein, surfaces of said reflection areas are defined by a function consisting of a product of a normal distribution type function and a periodic function added to a representation expression to thereby form a wave-like reflection surface, a circular wave spreading along said inclined plane being formed in an area of said second reflection area situated between said horizontal plane including the optical axis of said reflector and said inclined plane when said reflection surface is viewed from the front side thereof, and a plane wave spreading in the horizontal direction is formed in the remaining areas of said second reflection area.

4. The reflector for use in a vehicular headlight as set forth in claim 1 or 2, wherein said focuses of said parabolas defined by said intersections of said second and third reflection areas and said inclined surface are situated in the vicinity of a front end of said light source, and the surfaces of said reflection areas are defined by a function consisting of the product of a normal distribution type function and a periodic function added to a representation expression on the surfaces of said respective reflection areas to thereby form a wave-like reflection surface, a plane wave spreading in the horizontal direction being formed in said first and fourth reflection areas, whereas no plane wave is formed in an area of said second reflection area situated between said horizontal plane including the optical axis of said reflector and said inclined plane when said reflection surface is viewed from the front side thereof.

5. A reflector for use in a vehicular headlight capable of forming a low beam, the reflector having a basic surface arranged such that, as an angle of a reflection point of filament images increases commencing from a horizontal plane intersecting said reflector, filament images reflected from a first reflection area of said basic surface and formed on a screen disposed in front of said headlight extend parallel to a horizontal line in an image plane from a center axis, said filament images on said screen are then rotated clockwise beyond a vertical line in said image plane and are located on the left of the vertical line, then, said images on said screen are rotated toward the vertical line and are located such that a central axis thereof extends along a vertical direction.

6. The reflector as set forth in claim 5, wherein, as said angle of said reflection point increases from said horizontal plane, in a second reflection area, said filament images on said screen are rotated along the central axis from the vertical line up to an angle of 15° above the horizontal line, in a third reflection area said filament images on said screen are moved in parallel with the last position thereof reflected by said second reflection area and are rotated along the end of said filament image until said images are positioned on a vertical line, and in a fourth reflection area said images on said screen are rotated from a position just on the vertical line and then rotated in a reverse direction along the end of the image until being positioned on the horizontal line.

7. The reflector as set forth in claim 6, wherein said filament images reflected by said third reflection area are more spread out than those reflected by said fourth reflection area.

8. The reflector as set forth in claim 1, wherein said first, second, third and fourth areas are continuous with one another to form a single reflection surface having no stepped portions therebetween.

9. The reflector as set forth in claim 1, wherein equations representing said first, second, third and fourth areas are mathematically continuous with one another at boundaries between said first, second, third and fourth areas.

10. The reflector as set forth in claim 1, wherein said reflector produces a beam pattern having a bent cut line, said filament images having a jump portion at said bent line.

11. A reflector having a reflector shape defined by:

a) an x-axis extending in a positive and a negative x direction coincident with an optical axis of the reflector, b) a y-axis extending in a positive and negative y direction perpendicular with the x-axis and lying horizontally, c) a z-axis perpendicular with both the x-axis and the y-axis and lying vertically, extending in a positive and negative z direction, d) a vertex positioned at an origin at an intersection of the x, y, and z axis, e) a point F at a distance f from the vertex in the positive x direction along the x-axes, f) a point D at a distance d from the vertex in the positive x direction along the x-axis, g) a horizontal parabola, coincident with said reflector shape, lying in an x-y plane defined by the x-axis and the y-axis, said horizontal parabola having a focus at F, and defining the locus of points P, h) rays PM each corresponding to a corresponding one of said points P and originating from said corresponding one of said points P and extending in a direction identical to that which would result from a ray of light originating from point D, directed to said corresponding one of said points P, and reflecting from said horizontal parabola, said each ray PM lying in a corresponding plane which is parallel to said z-axis, i) said reflector shape further defined by a locus of parabolas, each of said parabolas corresponding to a corresponding one of said points P, said each of said parabolas being defined by an intersection of said corresponding plane and a corresponding paraboloid of revolution, where a focus of said paraboloid is at said point D, an axis of said paraboloid parallel with said each ray PM, and wherein said each paraboloid passes through said corresponding one of points P;

wherein the improvement comprises:

a) the reflector shape being further characterized by division thereof into reflection area 3, 4, 5, and 6, wherein reflection area 3 includes portions of the reflector in the positive y and z directions, reflection area 4 includes portions of the reflector in the negative y direction and in the positive z direction, and adjacent areas in the negative z direction from an inclined half plane lying in the negative y direction and which intersects with the x-axis, reflection area 5 includes portions of the reflector in the negative y direction and in the negative z direction outside of said reflection area 4;

b) the reflector being intended for use with a lamp filament extending along the x-axis having endpoints which, when projected perpendicularly on the x-axis, are designated points CE and CF, which are coincident with the x-axis, wherein CE is closer to the origin than CF, and a midpoint C' exists equidistant from CE and CF, also on the x-axis;

c) wherein said reflection area 3 is defined by F being located between C' and CE, and D being located slightly closer to the origin than point CE;

d) said reflection area 4 is defined by F and D being located slightly closer to the origin than point CE;

e) said reflection area 5 is defined by F being located slightly closer to the origin that point CE and point D being located slightly further from the origin than point CF; and f) said reflection area 6 is defined by F being located between points CE and C', and D being located slightly further from the origin that point CF.

12. A reflector having a reflector shape defined by:

a) an x-axis extending in a positive and a negative x direction coincident with an optical axis of the reflector, b) a y-axis extending in a positive and negative y direction perpendicular with the x-axis and lying horizontally, c) a z-axis perpendicular with both the x-axis and the y-axis and lying vertically, extending in a positive and negative z direction, d) a vertex positioned at an origin at an intersection of the x, y, and z axis, e) a point F at a distance f from the vertex in the positive x direction along the x-axes, f) a point D at a distance d from the vertex in the positive x direction along the x-axis, g) a reference parabola, coincident with said reflector shape, lying in one of an x-y plane defined by the x-axis and the y-axis and a plane inclined at a predetermined angle with respect to said x-y plane, said reference parabola having a focus at F, and defining the locus of points P, h) rays PM each corresponding to a corresponding one of said points P and originating from said corresponding one of said points P and extending in a direction identical to that which would result from a ray of light originating from point D, directed to said corresponding one of said points P, and reflecting from said reference parabola, said each ray PM lying in a corresponding plane which is parallel to said z-axis, i) said reflector shape further defined by a locus of parabolas, each of said parabolas corresponding to a corresponding one of said points P, said each of said parabolas being defined by an intersection of said corresponding plane and a corresponding paraboloid of revolution, where a focus of said paraboloid is at said point D, an axis of said paraboloid parallel with said each ray PM, and wherein said each paraboloid passes through said corresponding one of points P;

wherein the improvement comprises:

a) the reflector shape being further characterized by division thereof into reflection areas 3, 4, 5, and 6, wherein reflection area 3 includes portions of the reflector in the positive y and z directions, reflection area 4 includes portions of the reflector in the negative y direction and in the positive z direction, and adjacent areas in the negative z direction from an inclined half plane lying in the negative y direction and which intersects with the x-axis, reflection area 5 includes portions of the reflector in the negative y direction and in the negative z direction outside of said reflection area 4;

b) the reflector being intended for use with a lamp filament extending along the x-axis having endpoints which, when projected perpendicularly on the x-axis, are designated points CE and CF, which are coincident with the x-axis, wherein CE is closer to the origin than CF, and a midpoint C' exists equidistant from CE and CF, also on the x-axis;

c) wherein said reflection area 3 is defined by F being located between C' and CE, and D being located slightly closer to the origin than point CE;

d) said reflection area 4 is defined by F and D being located slightly closer to the origin than point CE;

said reflection area 5 is defined by F being located slightly closer to the origin that point CE and point D being located slightly further from the origin than point CF; and f) said reflection area 6 is defined by F being located between points CE and C', and D being located slightly further from the origin than point CF.

* * * * *